United States Patent [19]

McGarrah et al.

[11] Patent Number: 4,754,562

[45] Date of Patent: Jul. 5, 1988

[54] DRIVEWAY SNOW PLOW

[76] Inventors: James E. McGarrah, 1762 Lang Dr.; Jack W. Kier, 1766 Lang Dr., both of Crofton, Md. 21114

[21] Appl. No.: 926,422

[22] Filed: Nov. 3, 1986

[51] Int. Cl.[4] ..... E01H 5/00

[52] U.S. Cl. ..... 37/232; 37/279; 37/283

[58] Field of Search ..... 37/231, 232, 279, 233, 37/235, 266, 268, 270, 263, 267, 269, 272, 281, 282, 283

[56] References Cited

U.S. PATENT DOCUMENTS

| | | | |
|---|---|---|---|
| 1,694,174 | 12/1928 | Greenwood | 37/232 |
| 2,307,655 | 1/1943 | Arps | 37/231 |
| 3,028,692 | 4/1962 | Brock | 37/281 |
| 3,302,958 | 2/1967 | Fawcett | 37/231 |
| 3,349,507 | 10/1937 | Payne | 37/231 |
| 3,465,456 | 9/1969 | Meyer | 172/701.3 X |
| 3,524,269 | 8/1970 | Jackoboice | 37/231 |
| 3,760,516 | 9/1973 | Billingsley | 37/231 |
| 3,800,447 | 4/1974 | Harvey | 37/279 |
| 4,262,753 | 4/1981 | Vanchot | 172/701.3 X |
| 4,403,432 | 9/1983 | Biance | 37/268 X |
| 4,470,211 | 9/1984 | Rossmann | 37/231 |

FOREIGN PATENT DOCUMENTS

| | | | |
|---|---|---|---|
| 0975035 | 11/1964 | United Kingdom | 37/232 |
| 1022410 | 3/1966 | United Kingdom | 37/268 |

*Primary Examiner*—Edgar S. Burr
*Assistant Examiner*—James A. Lisehora
*Attorney, Agent, or Firm*—Beveridge, DeGrandi & Weilacher

[57] ABSTRACT

A snow plow assembly which can quickly and easily be attached to and detached from a variety of different type vehicles. The assembly including a tongue member pivotably connected to a bracket which in turn is attached to a plow blade. The tongue member having a coupling device on its other end for attachment to a vehicle while a stabilizer bar is also attached at one of its ends to the vehicle so as to prevent lateral movement of the assembly. The plow blade is locked at a desired angle by the insertion of a single pin member through a plurality of aligned holes formed in the stabilizer bar, tongue member, and the support bracket. Additionally, compression springs are used to allow the plow blade to tip with respect to the support bracket so as to insure that both the plow assembly and the vehicle are not subject to undue stress when the blade hits an immovable object.

16 Claims, 2 Drawing Sheets

FIG. 4
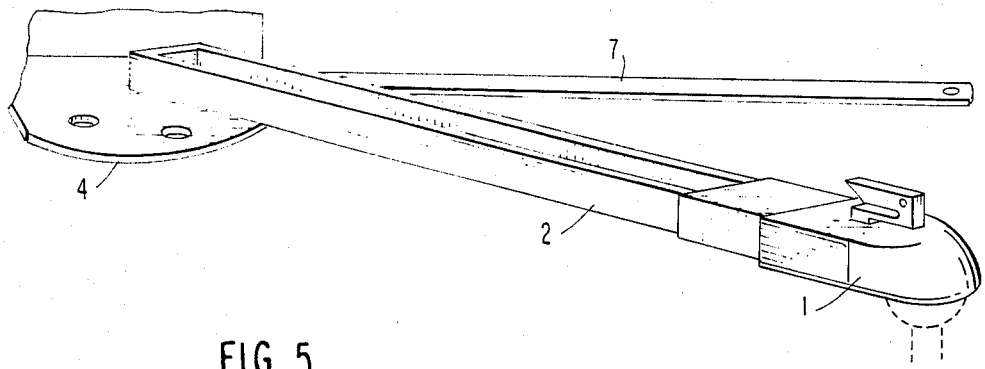
FIG. 5
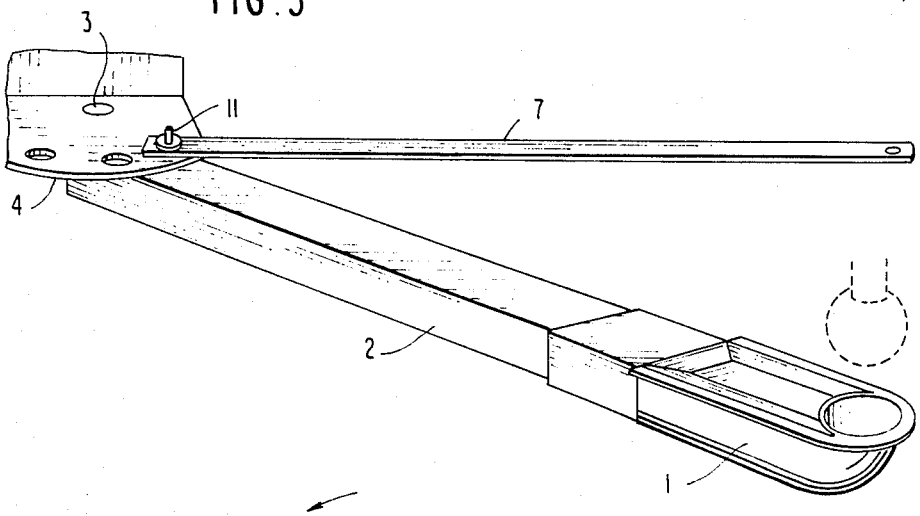
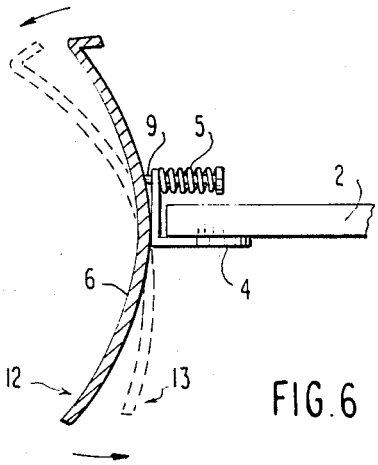
FIG. 6

DRIVEWAY SNOW PLOW

BACKGROUND OF THE INVENTION

1. Field of the Invention

This invention relates to a plow assembly for attachment to a motor vehicle. More particularly, this invention relates to a lightweight snow plow assembly which is both easy to attach to an automobile and easy to remove therefrom.

2. Description of the Prior Art

With the cost of snow removal increasing each year, homeowners and business owners have sought alternative and less expensive ways of removing snow.

One such way is the attachment of a snow plow assembly to one's own vehicle, thereby avoiding the need to pay someone else who has attached a plow blade to their truck. The attachment of a snow plow assembly to a vehicle, however, poses many difficulties. For instance, there is a requirement that the attached snow plow blade not create or allow any undue stress to be placed on the vehicle. Additionally in order for such a plow assembly to be practical there is a need for quick and easy attachment and detachment of the plow assembly. Likewise, there is a requirement that the plow assembly be suitable for use on a wide variety of vehicles commonly owned by the average home owner. Furthermore there is the requirement that the snow plow assembly be compact, that is, the snow plow blade assembly must be compact enough for easy storage in places such as a home owner's garage. Moreover, there is the requirement that the snow plow blade assembly be complete in and of itself or in other words there can not be unsightly and fuel wasting components of the plow assembly permanently secured to the vehicle after detachment of the plow blade.

U.S. Pat. No. 4,470,211 to Rossmann discloses the attachment of a thrust frame, having a snow plow blade attached thereto, to a hitching device on a vehicle. The blade is positioned on the end of the vehicle which is opposite the end having the hitching means thereby requiring extensive frame structure to encompass the vehicle. This extensive framework gives the invention the disadvantage of not being easily compacted for storage even despite its ability to partially fold up after use. Additionally, the thrust assembly is difficult to set up as it requires alignment of components of the thrust frame on both sides of the vehicle. This is something which is not always easy to do, especially in the smaller two car garages which have limited space between the cars or between the cars and the side walls of the garage. Moreover, because of the extensive framework, just placing the frame structure in proper position would require too much time to make such a system practical.

U.S. Pat. No. 3,760,516 to Billingsley discloses a snow plow which is connected, in part, to the rear axle of a vehicle. Although such a structure is relatively easy to assemble it does not insure that the vehicle will not be structurally damaged. The positioning of force absorbing components of a plow assembly on a car axle is disfavored, as the rear axle can be bent out of alignment which would require extensive and expensive vehicle repair work. This is especially true for some of the smaller vehicles which have small diameter rear axles.

U.S. Pat. No. 3,349,507 to Payne discloses the attachment of a snow plow assembly to the bumper of a car. The attachment of the plow assembly, however, to a bumper on a car poses the problem of adequate structural support. For example, many of the older cars have bumpers which are rusted and/or extensively damaged due to accidents and are thus not capable of providing the necessary structural support for the heavy plow blade contemplated in Payne. Furthermore, the heavy plow blade in Payne is difficult to move from location to location and, because it is massive in size, it makes storage difficult. Additionally the contemplated plow assembly attachment means to the bumper is complicated and difficult to manipulate especially when one's hands become cold.

SUMMARY OF THE INVENTION

It is the object of this invention to overcome the above defined problems and difficulties. This object is achieved by the utilization of a novel snow plow assembly which, inter alia, is easy to assemble and disassemble, lightweight and compact for storage purposes and designed so as not to place any undue burden on the car structure. The plow assembly of the present invention can be easily attached to a vehicle stored in a garage so that the driver of the vehicle can clear the driveway upon backing out.

The plow assembly of the present invention includes a lightweight plow blade having a pair of handle holes formed in it for ease in moving from location to location. The blade is connected to a support bracket by passing a series of elongated bolts through aligned holes formed in both the mid-region of the plow blade and one leg of the L-shaped support bracket. Compression springs surround the shafts of the bolts and are fixed between the heads of the bolts and the support bracket. The compression springs, in part, insure that no undue stress is placed on either the vehicle or the rest of the plow assembly. The springs accomplish this insurance feature by allowing the plow blade to tip in respect to the support bracket whenever an immovable structure is in the blade's way.

The second leg of the support bracket has a plurality of holes formed in it. One of these holes is a pivothole through which a fastening device is passed when connecting the blade to one end of a tongue member. The tongue member is in the form of an elongated bar and the fastening device connecting the tongue member to the second leg of the bracket is such that the tongue member can freely pivot with respect to the second leg of the support bracket. The tongue member has an additional hole formed in it which is a short distance from the aforementioned hole formed at the end of the tongue member. The other end of the tongue member has attached to it a trailer coupler which is of the type commonly used to attach trailers to a trailer ball secured to the framework of a car or truck. While this type of coupling means is disclosed, the use of other coupling means will be obvious to those skilled in the art.

As indicated previously, the support bracket has a plurality of holes formed in it. A series of these holes are formed close to the convex free edge of the leg of the bracket which is not in contact with the plow blade. The bracket also has a pivot hole located between the series of holes in the leg and the vertex of the L-shaped bracket. The tongue member is positioned so that when it is pivoted about the first hole at its end the holes along the convex edge of the L-shaped bracket line up with the second hole in the tongue member.

The present invention also includes a stabilizer bar having a hole formed at each end. The stabilizer bar is of a length which allows for one of its holes to be aligned with the second hole of the tongue member and the other of its holes to be in a position for easy securement to the bumper of a vehicle. With the hole in the stabilizer bar in alignment with the second hole in the tongue member it is possible to pivot and subsequently fix the blade and attached bracket into a plurality of angled positions. This versatiliy of blade angle is achieved by first attaching the trailer coupler to the trailer hitch or ball found or easily installed on almost every type of vehicle. The blade and attached bracket are then rotated about the fastening device connecting the support bracket to the first hole in the tongue member. Once in a desired position a pin member is slipped down into the hole in one end of the stabilizer bar, the second hole of the tongue member and one of the holes of the support bracket close to the convex free edge of the support bracket. Lastly, the second end of the stabilizer bar is secured to the bumper of the vehicle. The side of the bumper on which the end of the stabilizer bar is attached is the side which the side edge of the blade is closest to.

Hence, it is apparent that the present invention features a structure which can be quickly and easily attached to most any type of vehicle. The requirements for attachment includes the connection of a trailer hitch to a trailer ball, the slipping of a pin member through a plurality of aligned holes and the securement of one end of the stabilizer bar to the bumper. As the pin member travels through and acts to lock in place the stabilizer bar, support bracket and tongue member, a great deal of time and effort is saved.

Similarly, detachment can be accomplished as quickly and easily as attachment as it requires the same steps, only in reverse.

The present invention also represents a structure which is very easy to store away as it takes up very little space. After the plow assembly of the present invention is detached from a vehicle the pin is removed from the aligned holes and the tongue bar is pivoted about the first hole in its end until it comes in contact with the plow blade. As the tongue member is preferably made of a length which is less than the length of the plow blade and the tongue member, in its storage position, is parallel to the blade length, the whole assembly can be easily tucked away and stored.

Also, in addition to the tipping feature of the plow blade in the present invention, the tongue member is connected to the trailer ball which, as is well known, is secured directly to the frame of the vehicle. Additionally, the stabilizer bar is connected to the bumper of the vehicle. Thus, the present invention distributes the stresses created during plowing in an efficient manner. That is, the large forces created during plowing are absorbed by the strongest structure of the vehicle, its frame, while the lesser lateral forces created are passed through the stabilizer bar and passed to the bumper. This assembly thus insures that the vehicle is not subjected to forces which could damage the vehicle.

Accordingly, this invention provides for an improved snow plow assembly for attachment to a variety of types of vehicles which overcomes problems associated with the snow plow assemblies of the prior art.

BRIEF DESCRIPTIONS OF THE DRAWINGS

Additional improvements and advantages of the present invention will become more apparent from the following detailed description taken in conjunction with the accompanying drawings wherein:

FIG. 4 illustrates an enlarged cutaway section of the present invention of one possible position of the tongue member with respect to the support bracket and trailer ball.

FIG. 5 illustrates an enlarged cutaway section of the present invention of a second possible position of the tongue member with respect to the support bracket and trailer ball.

FIG. 6 illustrates a side view of the plow blade and the movement the blade is capable of.

DETAILED DESCRIPTION OF THE DRAWINGS

Figure 2:
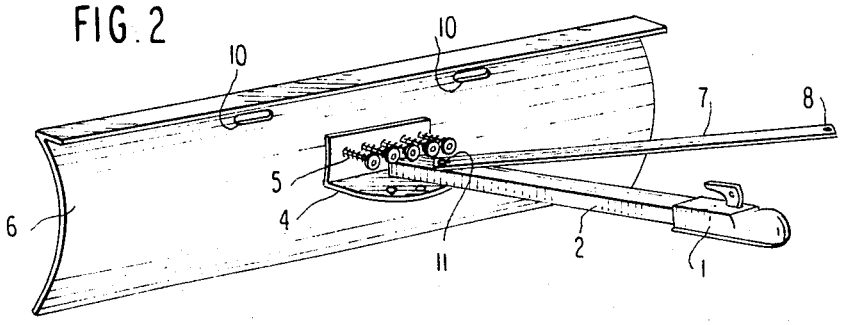
FIG. 2 illustrates a perspective view of the plow assembly in its detached state with emphasis on the compression springs attached thereto.
Figure 3:
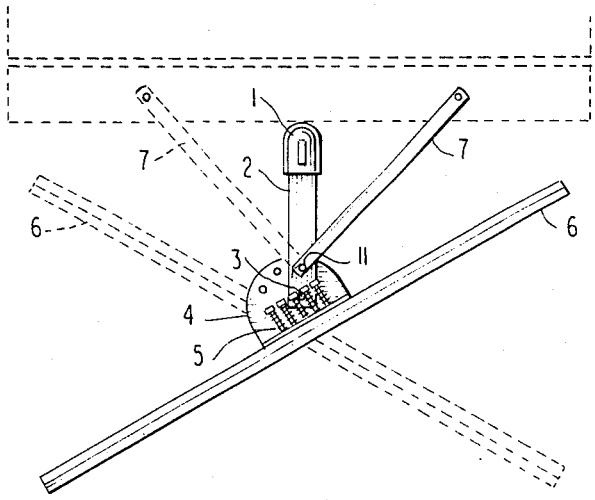
FIG. 3 illustrates, in accordance with the present invention, two possible blade angle positions.

Referring to FIG. 2, there is illustrated a curved plow blade 6 having at its uppermost edge a pair of handle holes 10. An L-shaped support bracket 4 includes a plurality of holes formed therein. The support bracket has a horizontal plate forming one of the legs of its L-shape and a vertical plate affixed to the blade 6 forming the other leg. A plurality of holes are formed in and, as shown in FIGS. 3 and 5 a series of holes are formed an equal distance from and adjacent the convex free edge of the horizontal plate. Also, as shown in FIG. 5, an additional hole is formed close to and at about the mid-point of the non-free edge of the horizontal support plate.

Figure 1:
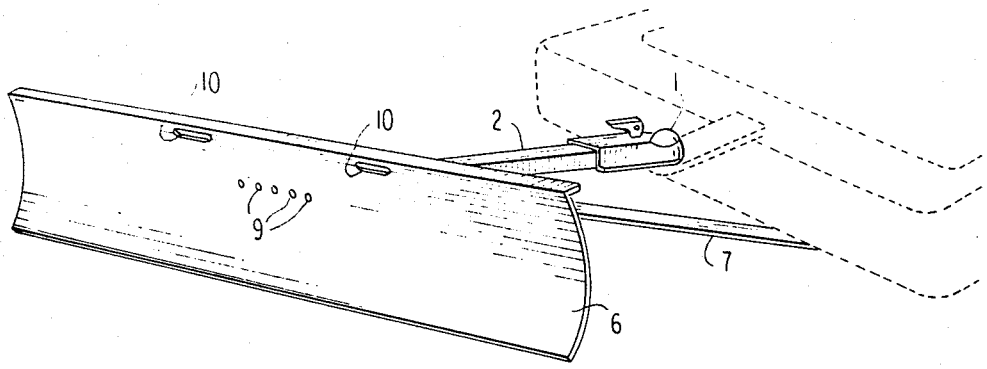
FIG. 1 illustrates a perspective view of a preferred embodiment of the plow assembly in its attached state.

Referring to FIGS. 1 and 2, a plurality of bolts 9 extend through aligned holes in both the plow blade and the vertical plate of support bracket 4. The heads of the bolts 9 extend outwardly from the vertical plate of support bracket 4 and compression springs 5 are positioned in between the inner surface of the heads of bolts 9 and the surface of the vertical plate not in contact with plow blade 6. The compression springs 9 allow the plow blade 6 to pivot so as to allow the blade 6 to pass over immovable objects (not shown). FIG. 6 illustrates the normal position 12 of blade 6 and position 13 to which the blade pivots when it comes in contact with an immovable object on the surface being plowed.

Referring again to FIG. 2 there, is further shown tongue member 2 having a first throughole very close to one of its ends adjacent the blade 6 through which fastening device 3 extends. Fastening device 3 affixes tongue member 2 to bracket 4 in a manner which allows each to pivot about the other. Tongue member 2 also has a second hole formed in it that is at a distance from the first hole which is equal to the distance the series of holes along the convex edge of the horizontal plate are from the hole on the horizontal plate through which fastening device 3 extends. This equality of distance allows for the alignment of the hole in the tongue member with the holes along the convex edge of the horizontal plate of support bracket 4.

FIG. 2 also reveals lateral tension stabilizer bar 7 having holes at each end and trailer coupler 1 attached to the end of the tongue member opposite the end having the hole for receiving fastening device 3.

To attach the plow assembly to a vehicle, trailer coupler 1 is attached to a trailer ball, which is shown in dashed lines in FIGS. 4 and 5. Likewise, one end of the stabilizer bar is attached to the bumper of a vehicle as shown in FIGS. 1 and 3 by way of fastening device 8, FIG. 2. The blade angle can be adjusted as shown in FIG. 3 to be in any one of a plurailty of positions. Adjustment is accomplished by pivoting the support bracket and attached blade so as to align one of the holes along the convex edge of the horizontal plate with the hole in the tongue member and the hole in the lateral tension stabilizer bar 7. To lock the blade 6 in position, pin member 11 is inserted down through the aligned holes in the stabilizer bar, tongue member and support bracket.

It should be noted that the foregoing is just one possible way of attaching the plow assembly to the vehicle, as it is possible to lock the blade in position via pin member 11 before the fastening device 8 and trailer coupler 1 are secured to the vehicle.

Also, a comparison of FIGS. 4 and 5 reveals how the present invention can be adapted for attachment to either an upwardly extending trailer ball or to a downwardly extending trailer ball.

While the snow plow assembly has been described and exemplified in terms of a preferred embodiment those skilled in the art will appreciate that modifications can be made without departing from the spirit and scope of this invention.

What is claimed is:

1. A snow removal device removably attachable to a vehicle comprising a snow blade, an L-shaped spring support bracket, one side of said L-shaped bracket being affixed to the rear of said snow blade, the other side of said L-shaped bracket having a series of holes near its outer edge, and a pivot hole located between said series of holes and the vertex of said L-shaped bracket, a tongue having a U-shaped cross-section pivotally connected to said L-shaped bracket at said pivot hole, said tongue having a trailer coupling bolted to its rearward end for attachment to a vehicle, a stabilizer bar connected between said tongue and said vehicle, a removable pin securing said stabilizer bar to said tongue, said pin extending through three aligned holes, one of said aligned holes being at one end of said stabilizer bar, a second of said aligned holes being in said tongue and the third of said aligned holes being one of said series of holes in said L-shaped bracket, the other end of said stabilizer bar being fixed to said vehicle, means to prevent a severe impact being transferred to said vehicle upon said snow blade striking an obstruction, said means including a row of horizontally oriented bolts securing said L-shaped bracket to the rear of said snow plow, said bolts each passing through a compression spring, said L-shaped bracket and said snow blade.

2. A snow removal device removably attachable to a vehicle comprising a snow blade;

an L-shaped spring support bracket, one side of said L-shaped bracket being affixed to the rear of said snow blade, the other side of said L-shaped bracket having a series of holes near its outer edge, and a pivot hole located between said series of holes and the vertex of said L-shaped bracket;

a tongue pivotally connected to said bracket at said pivot hole, said tongue having a trailer coupling secured to its rearward end for attachment to a vehicle, a stabilizer bar connected between said tongue and said vehicles;

a removable pin securing said stabilizer bar to said tongue, said pin extending through three aligned holes, one of said aligned holes being at one end of said stabilizer bar, a second of said aligned holes being in said tongue and the third of said aligned holes being one of said series of holes in said bracket;

the other end of said stabilizer bar being removably secured to said vehicle;

means to prevent a severe impact being transferred to said vehicle upon said snow blade striking an obstruction, said means including a row of fastening means securing said bracket to the rear of said snow plow, each of said fastening means in said row passing through a compression spring, said bracket and said snow blade.

3. A snow plow assembly releasably attachable to a vehicle, comprising:

an elongated tongue member being in the form of a unitary bar and having a first end and a second end, said tongue member also having a first through-hole formed therein near said first end;

a trailer coupler attached to the second end of said tongue member, said trailer coupler including coupling means for securement of said trailer coupler to a vehicle;

a support bracket having a plurality of holes formed therein;

a stabilizer bar having a first end and a second end with the first end including fastening means for the securement of said stabilizer bar to the vehicle and the second end having a hole formed therein;

a pin member extending through the through-hole near the first end of said tongue member, through the hole in the second end of said stabilizer bar, and through a first hole in said support bracket and said stabilizer bar being pivotably secured to said pin member such that the first end of said stabilizer bar is adapted to be spaced to one side of the second end of said tongue member; and a snow plow blade connected to said bracket member.

4. A snow plow assembly as recited in claim 3 wherein said tongue member has a second through-hole formed therein which is positioned between the first through-hole and the edge of the first end of said tongue member; and said plow assembly further comprises a fastening device extending through said second through-hole and through a second hole in said support bracket so as to secure said tongue member to said support bracket in a pivotable fashion.

5. A snow plow assembly as recited in claim 4 wherein said support bracket includes a first plate and a second plate with each plate joined at their edges so as to give said bracket essentially an L-shape.

6. A plow assembly as recited in claim 5 wherein said first plate has a series of horizontally aligned holes formed therein and said snow plow blade has a series of horizontally aligned holes formed therein whereby said horizontally aligned holes in said plow blade are aligned with the horizontally aligned holes in said first plate.

7. A plow assembly as recited in claim 6 further comprising a plurality of bolt members extending through the holes in said plow blade and said first plate which are aligned; and a plurality of coiled compression springs with each spring having one of said bolt members extending through the interior of its coil and each spring being fixed in place between the head of said bolt member and the surface of said first plate such that said plow blade is free to move in relationship to said first plate.

8. A plow assembly as recited in claim 5 wherein said second plate has a free edge of convex shape and the first hole formed in said support bracket is positioned in said second plate and is any one of a series of holes formed near, and at an equal distance from, the free convex edge of said second plate.

9. A plow assembly as recited in claim 8 wherein the second hole formed in said support bracket is located in said second plate and is positioned near and about at the midpoint of the non-free edge of said second plate, whereby said tongue member can be pivoted about said second hole in said second plate member so as to align, for pin insertion, the first through-hole in said tongue member with both the hole in the second end of said stabilizer bar and any one of the holes located near the free edge of said second plate such that the insertion of the pin results in said plow blade being fixed at a desired angle.

10. A plow assembly as recited in claim 4 wherein said plow blade is curved such that the center of radius is located on the side of said plow blade which is not in contact with said support bracket.

11. A plow assembly as recited in claim 4 wherein said plow blade has handle holds formed along an upper most edge of said plow blade.

12. A plow assembly as recited in claim 4 wherein said coupling means has a hemispherical bore formed therein for partial reception of a trailer ball secured to the framework of the vehicle and locking means for locking said coupling means to the trailer ball.

13. A plow assembly as recited in claims 4 wherein said tongue member has a U-shaped cross section.

14. A plow assembly as recited in claim 4 wherein the first end of said stabilizer bar is releasably secured to a bumper member of the vehicle.

15. A plow assembly as recited in claim 4 wherein said coupling means is releasably secured to a trailer ball attached to the vehicle.

16. A plow assembly as recited in claim 4 wherein said plow assembly weighs about 40 pounds.

* * * * *